US005117587A

United States Patent [19]

Doan

[11] Patent Number: 5,117,587

[45] Date of Patent: Jun. 2, 1992

[54] SEALING STRUCTURE

[75] Inventor: Daniel C. Doan, Marietta, Ohio

[73] Assignee: RJF International Corporation, Fairlawn, Ohio

[21] Appl. No.: 694,835

[22] Filed: May 2, 1991

[51] Int. Cl.[5] ..... E06B 7/16

[52] U.S. Cl. ..... 49/495; 49/383; 49/475; 49/498

[58] Field of Search ..... 49/495, 498, 478, 484, 49/383, 475

[56] References Cited

U.S. PATENT DOCUMENTS

| | | | |
|---|---|---|---|
| 2,263,806 | 11/1941 | Hammerl | 49/498 |
| 3,238,573 | 3/1966 | Pease, Jr. | 49/478 X |
| 3,761,347 | 9/1973 | Yackiw | 49/495 X |
| 3,851,420 | 12/1974 | Tibbetts | 49/495 X |
| 3,952,455 | 4/1976 | McAlarney | 49/498 X |
| 4,006,562 | 2/1977 | Belanger et al. | 49/495 X |
| 4,807,397 | 2/1989 | Doan | 49/383 X |
| 4,974,366 | 12/1990 | Tizzoni | 49/478 X |

FOREIGN PATENT DOCUMENTS

| | | | |
|---|---|---|---|
| 1375473 | 9/1964 | France | 49/495 |

*Primary Examiner*—Philip C. Kannan

*Attorney, Agent, or Firm*—Calfee Halter & Griswold

[57] ABSTRACT

Sealing structure for providing a seal between the perimeter of a door and a surrounding structure such as a door frame. The sealing structure is preferably formed as a tri-part extrudate and is particularly useful in providing a seal for a structure (e.g., a refrigerator, freezer, walk-in freezer, etc.) where it is desirable to obtain a hermetic and/or thermal seal.

9 Claims, 4 Drawing Sheets

SEALING STRUCTURE

FIELD OF THE INVENTION

The present invention relates to sealing structure for providing a seal between the perimeter of a door and a surrounding structure such as a door frame. The sealing structure is preferably formed as a tri-part extrudate and is particularly useful in providing a seal for a structure (e.g., a refrigerator, freezer, walk-in freezer, etc.) where it is desirable to obtain a hermetic and/or thermal seal.

BACKGROUND

In the past, different types of structures for providing a thermal and/or hermetic seal between a door and a surrounding structure have been suggested. One type of sealing structure, disclosed in U.S. Pat. No. 4,807,397, provides a honeycomb sealing structure along each of the hinge and closure sides of the door. The honeycomb structure comprises a base which is connected to the jamb of a door frame and a honeycomb which is integrally connected with the base. The honeycomb structure is formed as a co-extrusion of two different types of thermoplastic elastomer. A semi-rigid thermoplastic elastomer material forms a base which is connected to the jamb of a door frame. A flexible thermoplastic elastomer material forms a honeycomb which is integrally connected with the base. The honeycomb sealing structure extends about the perimeter of the door frame. The honeycomb sealing structure forms a compression seal against the peripheral edges of the door as the door is pivoted to a closed position relative to the door frame.

Another known structure for providing a thermal and/or hermetic seal between a door and a door frame is a magnetic sealing gasket. A base formed of a semi-rigid thermoplastic elastomer material is secured to the jamb of a door frame. A magnetic material is encased in a jacket formed of a flexible thermoplastic elastomer material, and a flexible bellows-like structure, also formed of the flexible thermoplastic elastomer material, connects the jacket to the base. The bellows-like structure biases the magnetic sealing gasket to a predetermined orientation when the door is in an open condition. As the door closes, the magnetic sealing gasket engages a selected part of the door and the flexible bellows-like structure allows a predetermined amount of reachout of the magnetic sealing gasket, to provide an effective thermal and/or hermetic seal between the door and the door frame.

With either a magnetic or a honeycomb type seal, it is important that the sealing structure be biased to an orientation relative to the door frame such that as the door is closed the sealing structure engages the door in a predetermined manner, to provide an effective thermal and/or hermetic seal. Otherwise, the sealing structure may provide an inadequate seal with the door, or might interfere with proper closure of the door.

Also, warpage of the door can make it difficult for a seal structure to achieve an adequate hermetic and/or thermal seal. Specifically, warpage of the door can cause peripheral edge portions of the door (which would normally engage the magnetic and/or honeycomb seal) to bow in such a manner as to make it difficult to achieve an effective thermal and/or hermetic seal about the entire perimeter of the door. In the past, one way the warpage problem has been addressed has been to provide an extrudate which forms a primary seal, and an additional sealing member which is stapled to the extrudate to form a secondary seal. The secondary seal is located to seal selected parts of the door and the door frame, to account for the warpage problem.

SUMMARY OF THE PRESENT INVENTION

The present invention provides new and useful sealing structure, designed especially for providing a hermetic and/or thermal seal between a door and a door frame.

According to a preferred form of the invention, different forms of sealing structure are provided along the hinge side and the closure side of a door and a surrounding door frame. The sealing structure disposed along the closure side comprises a magnetic sealing gasket and a secondary sealing member, formed together as a single, tri-part extrudate. The sealing structure along the hinge side of the door and frame comprises a honeycomb sealing structure and one or more secondary sealing members, also formed together as a single, tri-part extrudate.

Along the closure side of the door, a magnetic sealing gasket seals along an interior face of the door and the secondary sealing member seals along the adjacent side surface of the door. Normally, in the absence of door warpage, the magnetic sealing gasket would provide an adequate thermal and/or hermetic seal between the closure side of the door and the door frame, without the need for additional sealing structure. However, if door warpage is severe enough to preclude the magnetic sealing gasket alone from providing an effective seal, the secondary sealing member can still seal the side surface of the door in a manner which, when combined with the magnetic seal, should provide an effective seal between the door and the door frame.

Along the hinge side of the door, the honeycomb compression seal is adapted to seal about an edge of the door. The secondary sealing member is disposed between the honeycomb seal and the hinge of the door, and is disposed to seal against the side surface of the door. Again, the secondary sealing member is designed so that if door warpage causes the honeycomb seal alone to be ineffective to completely seal the hinge side of the door, the secondary seal can still seal against the side surface of the door in a manner which, when combined with the honeycomb seal, should effectively seal the hinge side of the door.

According to a particularly useful feature of the invention, the honeycomb seal comprises a tri-part extrudate with a new honeycomb configuration. Specifically, the honeycomb seal comprises a relatively rigid base with a flexible outer web and an inner web secured thereto. The base has a generally "L" shaped configuration. The flexible outer web extends from one leg of the base to the other leg, and together with the base forms a fluid chamber. Moreover, the flexible outer web forms a front leg which contacts the door and a rear leg which is compressed against one of the base legs as the door is closed. The inner web has a stem which connects to the base and a curved segment which is connected to the front leg of the outer web. Such a configuration promotes effective compression of the honeycomb seal as the door is being closed and provides good recovery of the shape of the honeycomb configuration when the door is opened.

Also according to the preferred embodiment, the honeycomb is formed of three different types of thermoplastic elastomeric materials. The outer web of the honeycomb is formed of a relatively soft, flexible type of thermoplastic elastomer material, and preferably a material sold by Shell Chemical Company under the trademark Kraton 1650/1651 (referred to herein as TPE). The base is formed of a semi-rigid form of thermoplastic elastomer material, preferably a Kraton 1650/1651 type with less plasticizer or more filler than the outer web (referred to herein as SR/TPE) which is tough and flexible, and provides good recovery of its original shape after compression. The inner web of the honeycomb is formed of a tough, flexible vulcanized rubber that processes as a thermoplastic, preferably a Santoprene® 101-73 type sold by Advanced Elastomer Systems, Akron, Ohio (referred to herein as VTR/TPE).

Further, according to the preferred embodiment, the magnetic sealing structure on the lock side of the door comprises a base formed of the semi-rigid type of TPE material, a flexible jacket and bellows-like structure are formed of the relatively soft, flexible type of TPE material, and the secondary seal is formed of the tough and flexible type VTR/TPE material.

Additionally, according to the preferred embodiment, at the header side of the door, a seal similar to the seal on the lock side of the door would be provided. Such a seal would include both a magnetic sealing gasket and a secondary seal.

Further objects and advantages of the present invention will become further apparent from the following detailed description and the accompanying drawings.

DETAILED DESCRIPTION OF THE PREFERRED EMBODIMENT

Figure 1:
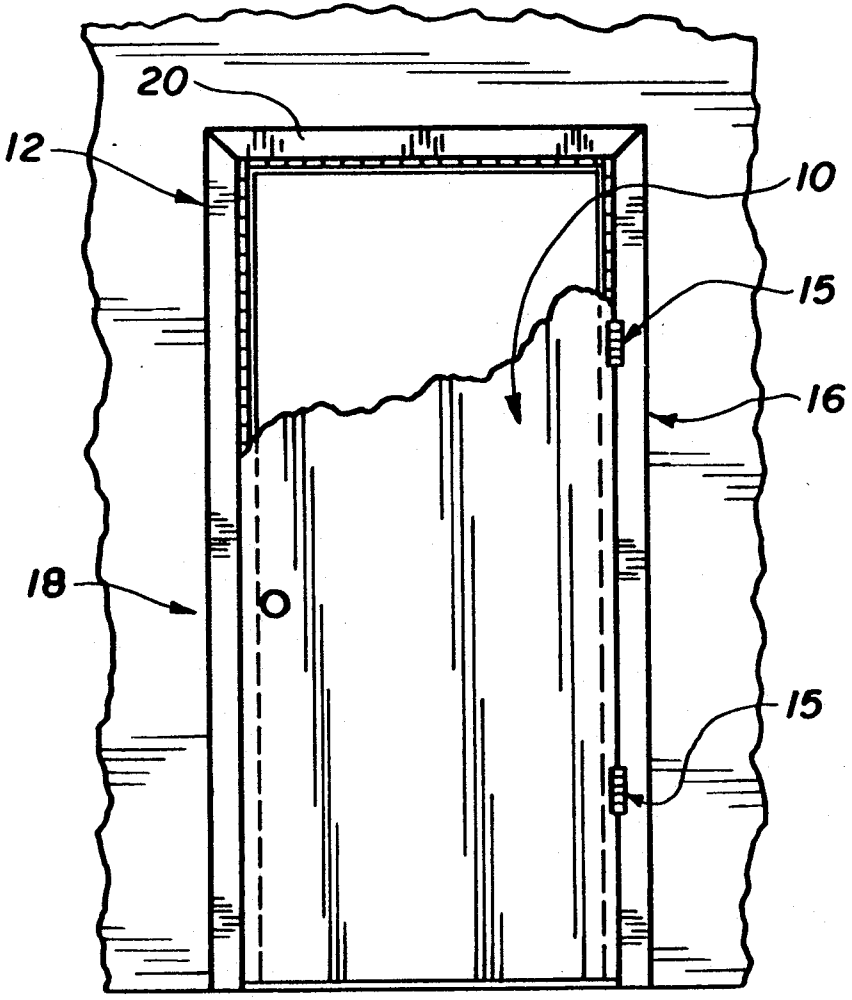
FIG. 1 is a fragmentary front view of a conventional door illustrating sealing structure according to the invention around the periphery of the door.
Figure 5:
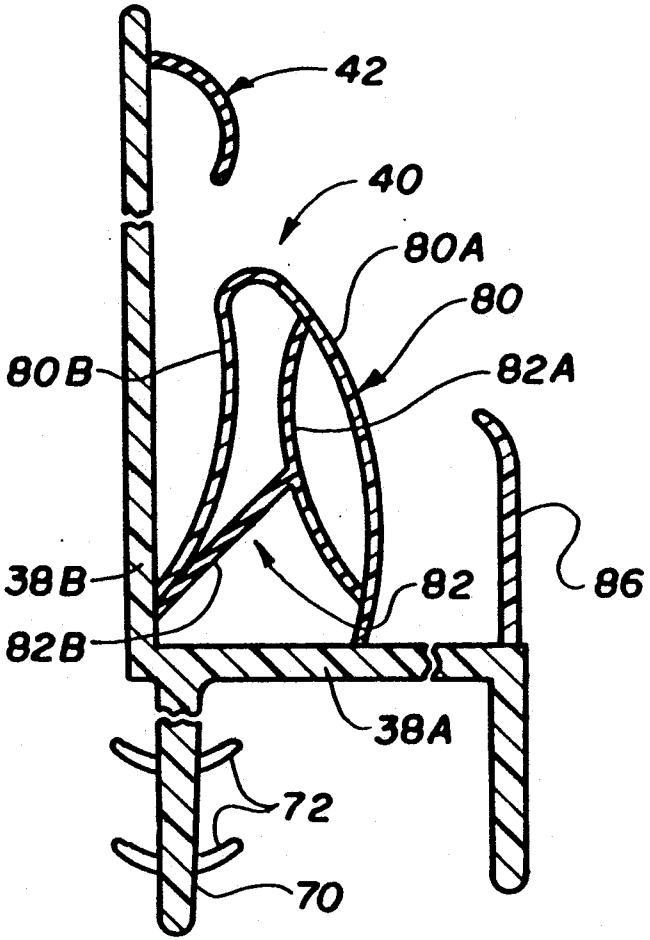
FIG. 5 is an enlarged fragmentary cross-sectional illustration of the honeycomb seal structure.
Figure 2B:
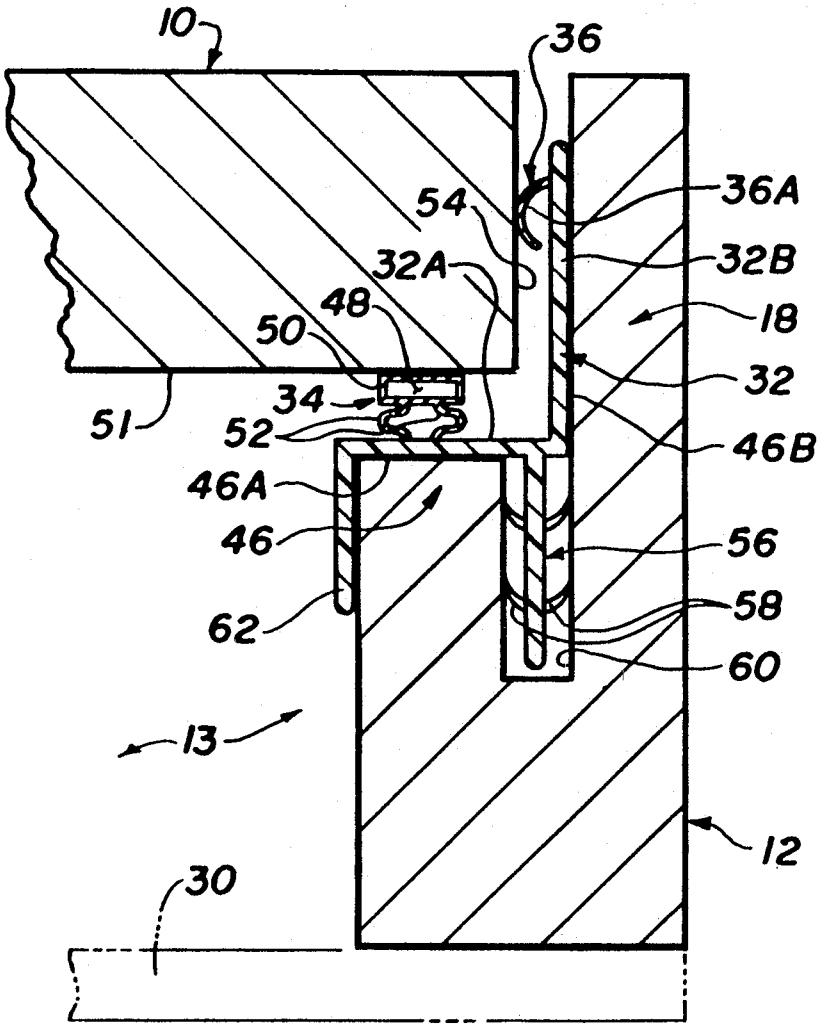
FIGS. 2*a* and 2*b* are fragmentary cross-sectional views of the hinge and lock sides of the door, respectively, in directions perpendicular to the lengths of the sealing structures, with the door in a closed position.
Figure 2A:
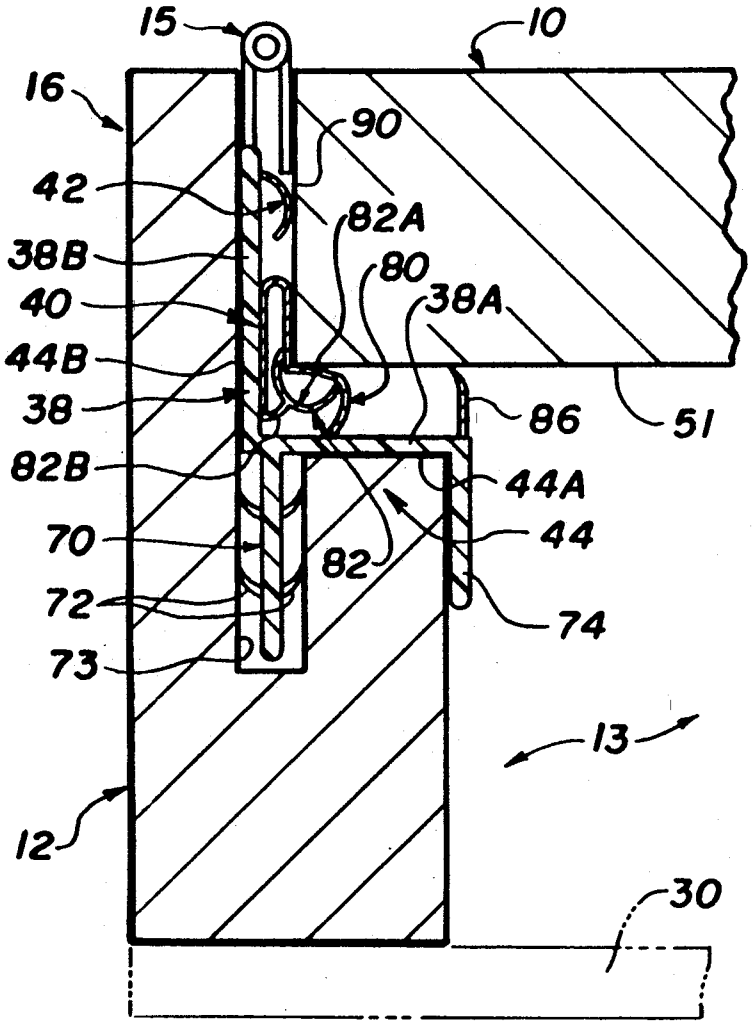
Figure 3B:
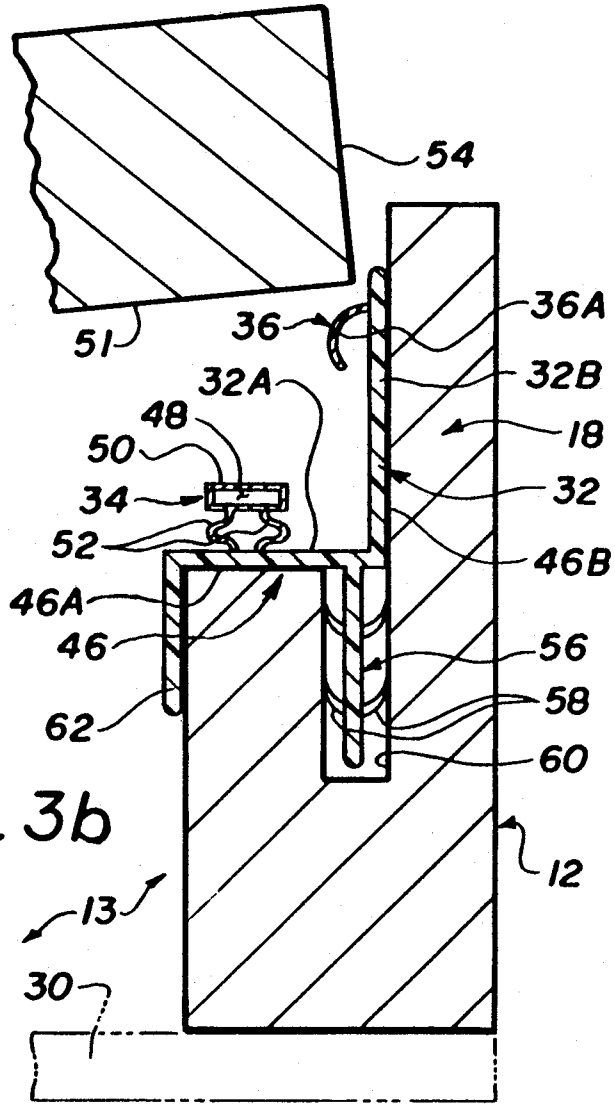
FIGS. 3*a* and 3*b* are fragmentary cross-sectional views of the hinge and lock sides of the door, respectively, in directions perpendicular to the lengths of the sealing structures, with the door in a partially closed position.
Figure 3A:
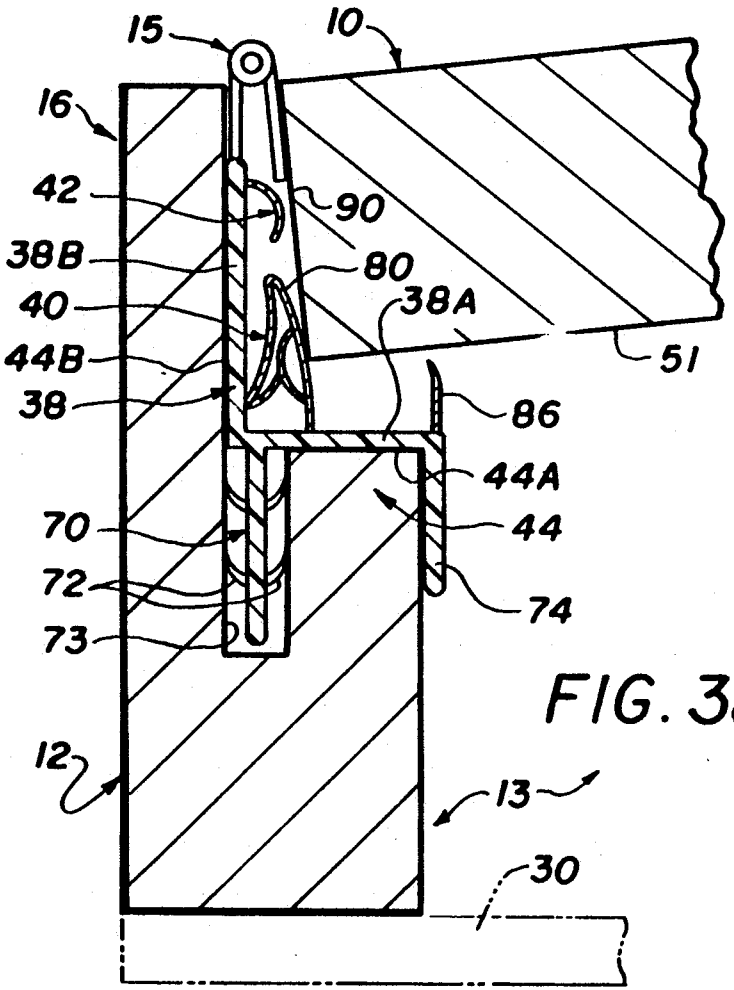
Figure 4B:
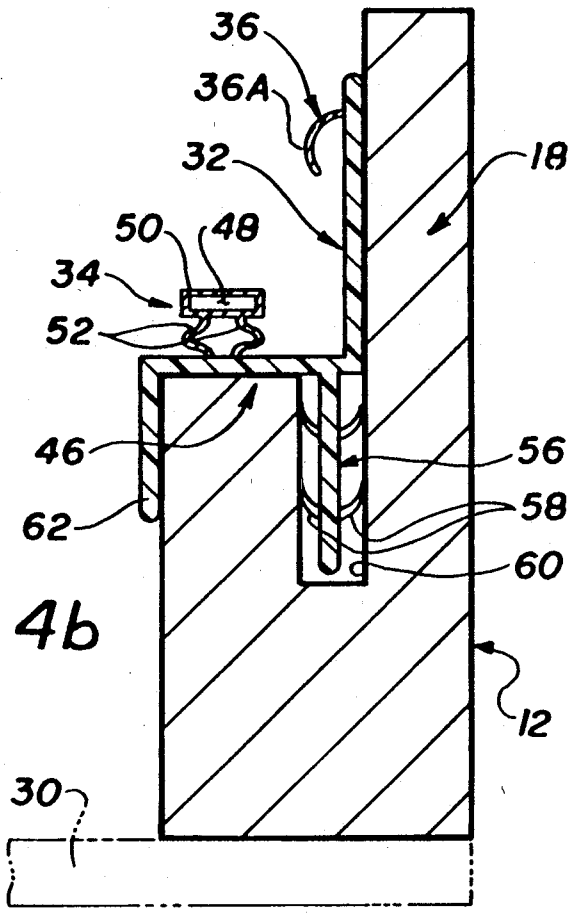
FIGS. 4*a* and 4*b* are fragmentary cross-sectional views of the hinge and lock sides of the door, respectively, in directions perpendicular to the lengths of the sealing structures, with the door in an open position.
Figure 4A:
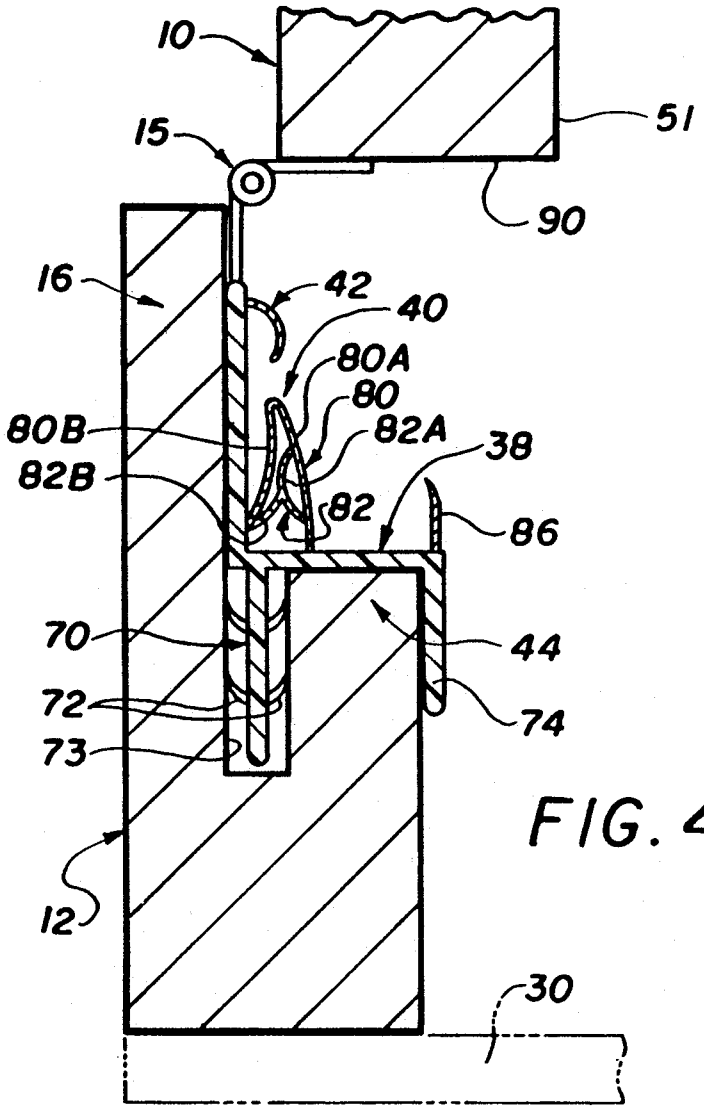

As discussed above, the present invention relates to sealing structure for sealing about a door and a surrounding door frame to provide a thermal and/or hermetic seal about the door and the door frame. The figures illustrate a door 10 and a surrounding frame 12. The frame 12 surrounds an opening 13 (FIGS. 2*a*, 2*b*, 3*a*, 3*b*, 4*a*, 4*b*) which is opened or closed, depending upon whether the door 10 is in an open or a closed position. In FIGS. 1, 2*a* and 2*b*, the door 10 is in a closed position. In FIGS. 4*a*, 4*b*, the door 10 is in an open position.

The door 10 is connected to one side 16 of the frame 12 (referred to as the "hinge side") by means of a pair of hinges 15. The other side 18 of the frame 12 (referred to herein as the "lock side") has conventional coupling means (not shown) for engaging a part of the door and for holding door in a closed position. A header 20 extends across the top side of the opening which is surrounded by the frame 12.

Sealing structures, each constructed according to the present invention, extend along the lock side 18 and the hinge side 16 of the frame, as well as along the header 20. Conventional sealing structure, not part of this invention, would be provided, if necessary, along the bottom of the door.

The door 10 has an open position and a closed position. When in an open position (FIGS. 4*a* and 4*b*), the door 10 uncovers the opening 13 in the frame 12. When in a closed position, the door 10 closes the opening 13 in the frame 10, thereby closing an interior chamber (shown schematically at 30) formed on the inside of the frame 12. When the interior chamber 30 forms part of a refrigerator or comparable structure, it is important to provide a thermal and hermetic seal between the door 10 and the frame 12. The thermal seal is effective against heat transmission into the chamber 30. The hermetic seal prevents air, water and/or other environmental materials from invading the chamber 30.

As described above, sealing structures according to the present invention are provided along the lock side 18 and the hinge side 16 of the door 10 and along the frame 12. On the lock side 18, there is a sealing structure comprising a base 32, a magnetic sealing gasket 34 and a secondary seal 36. Along the hinge side 16 there is a seal comprising a base 38, a compression honeycomb seal 40 structure and a secondary seal 42.

The frame 12 includes door jambs 44, 46 along the hinge and lock sides respectively. The door jamb 44 has surfaces 44A, 44B extending at right angles to each other. The door jamb 46 has surfaces 46A, 46B extending at right angles to each other. Although not specifically disclosed, still another jamb would be provided along the header 20, as is readily known to those of ordinary skill in the art.

Along the lock side 18 of the door jamb 46, the base 32 of the seal comprises a pair of legs 32A, 32B which extend at right angles to each other and match the configuration of the surfaces 46A, 46B of the door jamb 46. The magnetic sealing gasket 34 comprises a magnetic strip 48 disposed within a jacket 50, and a flexible bellows-shaped chamber formed by a pair of flexible legs 52 extending between the jacket 50 and the base leg 32A. The magnetic sealing gasket and the bellows-shaped chamber extend along the entire lock side of the door jamb as will be readily recognized by those of ordinary skill in this art.

The magnetic strip 48 may be made of a finely divided magnetizable material dispersed in a binder such as a thermoplastic or elastomeric polymer. Preferably, the magnetizable material is ferrite, such as barium ferrite and the polymer is a blend such as chlorosulfonated polyethylene/polyisobutylene, or the like as is conventionally known. Any moldable or extrudable magnetizable material, however, may be employed in the magnetic gasket of the present invention.

The magnetic strip 48 and the surrounding jacket 50 are designed to provide a significant contact surface between the door 10 and the flexible magnetic sealing gasket when the door is fully closed. The flexible legs 52 extending between the jacket 50 and the base leg 32A provide a flexible, spring-like chamber which exerts a certain bias urging the magnetic strip 48 and the surrounding jacket 50 away from the base leg 32 when there is no compressive forces on the magnetic gasket 34. Further, the flexible leg portions 52 allow the magnetic gasket 34 to be compressed between the inside face 51 of the door and the base leg 32A as the door 10 is fully closed.

The secondary seal 36 on the lock side 18 comprises a flexible sealing member 36A connected with the base leg 32B. The sealing member 36A is biased a predetermined distance toward the path of movement of the side surface 54 of the door 10 as the door is moving to its closed position. The sealing member 36A is curved inward in relation to the path of movement of the door 10. Moreover, the sealing member 36 is biased far enough away from the base leg 32B that it is compressed between the base leg 32B and the side surface 54 of the door 10 as the door is closed.

A locking stem 56 is integrally formed in one piece with the base leg 32A, and extends away from the base leg 32A. The locking stem 56 has deflectable fingers 58 which are resiliently deflected when the locking stem 56 is forced into a kerf 60 formed in the jamb 46, to connect the base 32 to the jamb 46. A protective flange 62 is also integrally formed with an end of the base leg 32A, and is adapted to overlay and protect a portion 64 of the jamb 46 when the base 32 is connected to the jamb.

Preferably, the magnetic gasket 34 is formed as a single tri-part extrudate. The base 32 (including the stem 56 and the flange 62) is formed of the relatively stiff type SR/TPE polymer (i.e., the Kraton 1650/1651 type elastomer with less plasticizer or more filler). The magnet jacket 50 and the legs 52 are formed of the soft, flexible TPE elastomer (i.e., the Kraton 1650/1651 type elastomer) which has good resistance to paint migration, which is relatively soft and flexible, and which allows the spring-type action of the magnetic gasket described above. The secondary seal member 36 is formed of the VTR/TPE type elastomer (i.e., the Santoprene ® type) which has good shape retention even after compression and even over significant temperature ranges.

The sealing structure on the hinge side 16 of the door comprises the base 38, the compression honeycomb seal 40 and the secondary seal 42. The base 38 comprises legs 38A, 38B which extend at a right angle to each other and match the profile of the surfaces 44A, 44B of the jamb 44. Moreover, a locking stem 70 (with deflectable fingers 72) is formed in one piece with the base leg 38A. Still further, a protective flange 74 is formed in one piece with an end of the base leg 38A. The locking stem 70 and deflectable fingers 72 secure the sealing structure to a kerf 73 formed in the jamb. The protective flange 74 covers an inside surface of the jamb when the sealing structure is coupled to the jamb.

The honeycomb seal 40 comprises an outer web 80 and an inner web 82. The outer web 80 extends between the base legs 38A, 38B. The outer web 80 forms an outwardly curved front portion 80A and an inwardly curved rear portion 80B. The outer web 80 combines with the base 38 to form a fluid chamber. The inner web 82 divides the fluid chamber into three smaller fluid chambers. The inner web 82 has a curved portion 82A and a relatively straight stem portion 82B. The curved portion 82A connects two portions of the outwardly curved front portion 80A of the outer web 80, and is curved away from the outwardly curved portion 80A. The relatively straight stem portion 82 extends from about midpoint of the curved portion 82 to a point along base leg 38B which is near the junction of base legs 38A, 38B. The honeycomb seal structure extends the length of the hinge side of the door frame, as will be readily recognized by those of ordinary skill in this art.

The secondary seal 42 is integrally formed with, and extends away from the base leg 38B. The secondary seal 42 is located between the honeycomb compression seal 40 and the door hinge 15. Moreover, an additional secondary seal 86 is integrally formed with, and extends away from, the base leg 38A.

The foregoing sealing structure is preferably formed as a tri-part extrudate. The base 38, locking stem 70 and protective flange 74 are formed of the relatively stiff type SR/TPE type material. The outer web 80 of the honeycomb seal, and the secondary seal 86 along the base leg 38A, are formed with the relatively soft, flexible type of TPE material. The secondary seal 42, and the inner web 82 of the honeycomb seal, are each formed of the VTR/TPE type material which has good form retention and recovery characteristics over a wide temperature range.

The foregoing combination of materials, and the configuration of the seal structure, combine to form an effective compression seal along the hinge side 16 of the door. On account of the form retention characteristics and configuration of the inner web 82, the outer web 80 of the honeycomb is biased in such a manner that the front portion 80A of the outer web engages the corner of door 10, as the door is being closed (see FIGS. 3A, 3B). As the door continues to close, the honeycomb seal is compressed in the manner illustrated in FIG. 2A, to effectively seal about the corner of the door. The secondary seal 42 is adapted to be compressed between the side surface 90 of the door and the base leg 38B as the door is being closed. The secondary seal 86 is compressed between the base leg 38A and the interior surface 51 of the door 10 as the door is closed.

Because the secondary seal 42 at the hinge side is located close to the hinge 15, the secondary seal 42 should be effective even if the door has significant warpage at the interior surface 51. Also, because the secondary seal 36 at the lock side is located along the base leg 32B, the secondary seal 36 should also be effective if the door has significant warpage at the interior surface 51. Together, the secondary seals are designed to provide additional sealing even if the primary magnetic seal (lock side) and/or the primary honeycomb seal (hinge side) become ineffective due to excessive warpage of the door.

Finally, it is contemplated that magnetic sealing structure similar to that along the lock side of the door and frame would also be provided along the header 20.

Thus, according to the invention, new and useful sealing structure for providing a hermetic and/or thermal seal between a door and a surrounding structure has been disclosed. With the foregoing disclosure in mind, it is believed that various obvious modifications of the sealing structure will become apparent to those of ordinary skill in the art.

What is claimed is:

1. An extrudate for use in forming a seal for an edge of a door jamb having an angular profile, said extrudate comprising:

(a) a base comprising a pair of legs forming an angular profile matching the angular profile of the jamb, (b) a connecting member extending away from the base and adapted to connect the base to the door jamb, (c) a honeycomb seal structure connected to the base and extending inward from the base, said honeycomb seal structure adapted to form a compression seal with a door when the door is in a closed position, and (d) a secondary seal extending away from one leg of the base and adapted to form an additional compression seal between a selected edge portion of a door and the one leg of the base when the door is in a closed position;

wherein said extrudate comprises three different materials, said base comprising a relatively rigid material forming said pair of legs, said honeycomb seal structure comprising an outer web formed of a relatively flexible material, said outer web extending between said pair of legs and cooperating therewith to define a main fluid chamber, said honeycomb seal structure having an inner web disposed within said main chamber and dividing said main chamber into a plurality of sections, said inner web formed of a third material with better recovery to compression than said second material, and said secondary seal being formed of said third material.

2. An extrudate as defined in claim 1, wherein said outer web of said honeycomb seal structure comprises a convex front portion extending away from one leg of said base and a concave back portion extending away from the other leg of said base, said inner web comprising an inner portion extending across and disposed opposite part of said convex front portion of said outer web and a stem portion extending from said inner portion to a position substantially adjacent the corner of said base.

3. An extrudate as defined in claim 2, wherein each of said first and second materials comprises a thermoplastic elastomer material and said third material comprises a vulcanized rubber which processes like a thermoplastic elastomer.

4. An extrudate as defined in claim 3, wherein said first and second materials each comprises a Kraton 1650/1651 type of material, said first material having less plasticizer or more filler than said second material to provide said first material with its semi-rigid characteristics, and said third material comprising a Santoprene® 101/73 type of material.

5. An extrudate as set forth in any of claims 1–4, including an additional seal extending away from the other leg of said base, said additional seal being formed of said second material.

6. An extrudate as defined claim 5, further including a flange extending away from the distal end of said other leg of said base, said flange providing a protective cover for a part of a door jamb, and said flange being formed of said first material.

7. An extrudate for use in forming a seal for an edge of a door jamb having an angular profile, said extrudate comprising (a) a base comprising a pair of legs forming an angular profile matching the angular profile of the jamb, (b) a connecting member extending away from the base and adapted to connect the base to the door jamb, and (c) a honeycomb seal structure connected to the base and extending inward from the base, said honeycomb seal structure adapted to form a compression seal with a door when the door is in a closed position, (d) said base comprising a relatively rigid material forming said pair of legs, said honeycomb seal structure comprising an outer web formed of a relatively flexible material, said outer web extending between said pair of legs and cooperating therewith to define a main fluid chamber, said outer web comprising a convex front portion extending away from one leg of said base and a concave back portion extending away from the other leg of said base, said honeycomb seal structure further having an inner web disposed within said main chamber and dividing said main chamber into a plurality of sections, said inner web formed of a third material with better recovery to compression than said second material, said inner web comprising an inner portion extending across and disposed opposite part of said convex front portion of said outer web and a stem portion extending from said inner portion to a position substantially adjacent the corner of said base.

8. An extrudate as defined in claim 7, wherein each of said first and second materials comprises a thermoplastic elastomer material and said third material comprises a vulcanized rubber which processes like a thermoplastic elastomer.

9. An extrudate as defined in claim 8, wherein said first and second materials each comprises a Kraton 1650/1651 type of material, said first material having less plasticizer or more filler than said second material to provide said first material with its semi-rigid characteristics, and said third material comprising a Santoprene® 101/73 type of material.

* * * * *